US005230939A

United States Patent [19]

Baum

[11] Patent Number: 5,230,939

[45] Date of Patent: Jul. 27, 1993

[54] FORMING OF PRESSED TRAYS

[75] Inventor: Gary A. Baum, Appleton, Wis.

[73] Assignee: James River Corporation of Virginia, Richmond, Va.

[21] Appl. No.: 577,118

[22] Filed: Sep. 4, 1990

[51] Int. Cl.[5] ..... B32B 3/02; B65D 90/04

[52] U.S. Cl. ..... 428/84; 428/34.2; 428/66; 428/81; 428/153; 428/155; 428/156; 428/157; 428/167; 428/192; 428/537.5; 229/2.5 R; 493/968; 220/405; 220/574; 220/609; 220/604; 220/610; 220/623; 220/624

[58] Field of Search ..... 428/81, 84, 130, 153, 428/155, 156, 172, 192, 532.5, 167, 34.2, 66, 80, 83, 157, 192; 162/109, 117, 194, 399; 229/1.5 R, 2.5 R; 493/152, 154, 396, 902, 968; 220/405, 608, 574, 609, 604, 610, 623, 624, 674, 677

[56] References Cited

U.S. PATENT DOCUMENTS

| | | | |
|---|---|---|---|
| 3,401,863 | 9/1968 | Earl | 229/2.5 |
| 3,720,365 | 3/1973 | Unger | 229/1.5 R |
| 3,792,809 | 2/1974 | Schneider et al. | 229/DIG. 4 |
| 4,606,496 | 8/1986 | Marx et al. | 229/5.8 |
| 4,609,140 | 9/1986 | Handel et al. | 229/5.8 |
| 4,721,499 | 1/1988 | Marx et al. | 493/339 |
| 4,721,500 | 1/1988 | Handel et al. | 493/339 |

*Primary Examiner*—Donald J. Loney

*Attorney, Agent, or Firm*—Sixbey, Friedman, Leedom & Ferguson

[57] ABSTRACT

A product press formed from a paperboard and a method for forming the same is provided, wherein the product includes a press formed three-dimensional curvilinear region having a desired shape and containing a formation improvement structure for facilitating the press formation and maintenance of the desired product shape and for preventing the machine directionality of the paperboard from distorting the product from its desired shape. The press formed paperboard product of the preferred embodiment comprises a planar wall having a periphery which is at least partially curvilinear and a peripheral wall angularly oriented with respect to the planar wall. The peripheral wall extends along at least a portion of the curvilinear periphery of the planar wall and the closest portion of the peripheral wall is spaced a substantial radial distance from the periphery of the planar wall. The press formed three-dimensional curvilinear region extends radially outwardly from the curvilinear periphery of the planar wall while simultaneously curving out of the plane defined by the planar wall. The formation improvement structure includes a peripherally extending crush score line having a substantial directional component extending generally parallel to the curvilinear portion of the periphery of the planar wall. The crush score lines may be circular, sinusoidal or saw tooth shaped.

25 Claims, 5 Drawing Sheets

FORMING OF PRESSED TRAYS

BACKGROUND OF THE INVENTION

1. Technical Field

This invention relates to the field of methods for forming pressed paperboard products such as paper trays and plates and to the products formed by such processes.

2. Description of Related Art

Paperboard products, such as trays and plates, are formed, generally, by a method of molding fibers from a pulp slurry into the desired form of the product or by pressing a paperboard blank between forming dies into the desired shape. Manufacturing of paper products by the press forming process provides a number of advantages typically not found in products produced by other methods, such as the molded pulp process. Pressed paperboard products can be decorated and coated with a liquid-proof coating before being stamped by the forming dies into the desired shape whereas pulp molding processes permit the coating and decoration steps to occur only during or after the molding step. Coating and decorating a non-planar surface normally tends to be more expensive and difficult. Further, pressed paperboard products generally cost less, and require less storage space and can sometimes be transported in a collapsed condition, unlike molded pulp articles. Because press formed paperboard products can be manufactured more cost effectively than molded pulp articles and can be provided with features which improve product functionality and use, the press forming process is practiced by a substantial number of manufacturers in the paper product industry.

Although providing the advantages described above, the press forming method and products produced thereby present significant problems due to the resistance to bending and the change in area required in order to form the blank into the desired three dimensional shape. Press formed products for which round shapes are desirable, such as bowls, plates and trays, have been identified as a specific problem area.

In particular, the resistance to bending is a result of the paperboard stiffness. The stiffness level must be high enough to at least provide the finished product with the capability of supporting items, such as food, liquid or other objects, placed on or within the product without collapsing or excessively bending or twisting. A high stiffness level, while necessary to allow the product to withstand the tension and stresses experienced during use, presents problems during the forming operation, such as resistance to bending. As a further consequence to this resistance to bending, press formed paperboard products for which a round shape is desired have a tendency to assume a more nearly oval or egg shape, resulting in an irregularly shaped finished product.

The tendency of products for which a round shape is desired to assume an oval or egg shape is caused by the differing stiffness levels of the paperboard, and the resistance to bending caused thereby, in the different portions of the paperboard blank. The differing stiffness levels of the paperboard result from the differing memory or tendency of the paperhoard to spring back in the machine as compared with the cross machine direction of the paperboard. The machine direction of the paperboard relates to the direction in which the paper stock moved as it was being formed. Because this movement tends to cause the paper fibers to align differently in the machine and cross machine directions of the paper stock, many of the paper's properties, such as strength and elastic memory, will vary in the machine and cross machine direction. When a paperboard blank is forced to bend, the tendency to return to its original shape (i.e., flat) will normally be greatest in the machine direction and least in the cross machine direction. When a flat paperboard blank is press formed into a paper plate, a flat bottom wall and a curved upturned sidewall are normally formed. The tendency of the board, along the periphery of the flat bottom wall, to spring back to a flat shape is greatest in the machine direction and least in the cross machine direction. As a consequence, the side wall tends to be more nearly oval shaped than round shaped, which is clearly undesirable for a product for which a round shape is expected by the ultimate user. Accordingly, manufacturers of pressed paper products, and, in particular, manufacturers of pressed paper products for which a round shape or partial round shape is desired, would be in a better position to capitalize on their inherent lower manufacturing costs if paperboard blanks could be designed to more readily and consistently assume the desired three-dimensional product shape and if finished products could be formed to resist any inherent tendency to deviate from their pressed shape.

Many attempts have been made to overcome the deficiencies experienced during the formation and use of press formed paperboard products. A known method for enhancing the ability of paperboard blanks to be press formed into a uniformly shaped product, as well as to increase the product's ability to maintain its desired shape, is to provide score lines on the blank from Which the paperboard product is pressed. The provision of score lines causes pleats, seams, flutes or corrugations to form in a more nearly predictable and controlled fashion to accommodate surface area reduction at certain locations in the blank, as required to form the blank into the desired three dimensional shape.

Specifically, with respect to products for which a round shape is desired, the area reduction of the product's side wall and rim has been accommodated by providing a score line arrangement on the blank comprising a plurality of radially extending score lines circumferentially disposed around the periphery of the blank. Examples of this configuration may be seen in U.S. Pat. Nos. 4,606,496 and 4,721,499, both to Marx et al. and assigned to the applicant of the subject invention. Such an arrangement does, to an extent, reduce the blank's resistance to being press formed and control the formation of wrinkles. However, the score line arrangement of Marx et al. can only improve the formation process in the region where the score line arrangement is disposed (i.e., a portion of the side wall, the rim and the outer lip of the container). Where a finished product having a round shape is desired, a blank including the radially extending score line arrangement of Marx et al. would still present substantial resistance during the forming operation and, further, would tend to assume a more nearly oval or egg shaped finished product. This is due to the existence of other, non-scored regions of the product which are problematic and have not been accounted for in the Marx et al. design.

One region of a press formed paperboard product, particularly one for which a round shape is desired, that presents a substantial amount of resistance to bending and assuming the desired three dimensional curvilinear shape is the portion of the product in and near the periphery of the bottom wall of the product. The resistance to bending in this region is a result of the paperboard stiffness and, as is described above, the tendency of the paperboard, along the periphery of the flat bottom wall, to spring back to a flat shape is greatest in the machine direction and least in the cross machine direction. As a consequence, the side wall tends to be more nearly oval shaped than round shaped. The score line scheme of Marx et al. does not alleviate this problem and cannot because no score lines are formed in the region immediately beyond the periphery of the flat bottom wall.

Notwithstanding the known score line arrangements for improving press forming of paperboard products, there is a need for a configuration that can prevent the machine directionality of the paperboard from distorting the product from its desired shape (i.e., round), can reduce the blanks resistance to being press formed to the desired shape, and can improve the product's ability to maintain the desired shape (i.e., not return to its original shape), while providing a product with sufficient strength and rigidity to withstand the tension exerted on the product during normal use.

SUMMARY OF THE INVENTION

The primary object of the present invention is to overcome the deficiencies of the prior art described above by providing a paperboard product integrally formed from a paperboard blank and a method for forming the same, including a score line arrangement which facilitates the formation of a paperboard product into the desired three dimensional product shape by preventing the machine directionality of the paperboard from distorting the product from its desired shape.

Another key object of the present invention is to provide a paperboard product and method of forming the same, including a score line arrangement which facilitates the formation of a paperboard product into the desired three-dimensional product shape, while reducing the resistance experienced during the forming operation.

Another key object of the invention is to provide a paperboard product having the capability to maintain the desired product shape, which has sufficient strength and rigidity to withstand the distorting forces exerted on the product during normal use.

Still another object of the present invention is to provide a paperboard product press formed from a paperboard having a machine directionality, wherein the product comprises a score line arrangement including a crush score line which extends along the entire peripheral length of a three-dimensional curvilinear region defined by the portion of the product joining the periphery of a planar wall (i.e., bottom wall) to a peripheral wall (i.e., sidewall) to control the effects of the paperboard's differing memory caused by the machine directionality of the paperboard and ensure the formation of a product having the desired three-dimensional shape.

Still another object of the present invention is to provide a paperboard product and a method for forming the same, wherein a product press formed from paperboard includes a press formed three-dimensional curvilinear region having a desired shape and containing formation improvement means for facilitating the press formation and maintenance of the desired product shape and for preventing the machine directionality of the paperboard from distorting the product from its desired shape. The press formed paperboard product comprises a planar wall having a periphery which is at least partially curvilinear and a peripheral wall angularly oriented with respect to the planar wall. The peripheral wall extends along at least a portion of the curvilinear periphery of the planar wall and the closest portion of the peripheral wall is spaced a substantial radial distance from the periphery of the planar wall. The press formed three-dimensional curvilinear region extends radially outwardly from the curvilinear periphery of the planar wall, while simultaneously curving out of the plane defined by the planar wall. The formation improvement means includes a peripherally extending crush score line having a substantial directional component extending generally parallel to the curvilinear portion of the periphery of the planar wall.

Yet another object of the invention is the provision of formation improvement means wherein the crush score line includes a pair of score lines oriented parallel to and at spaced radial distances from the curvilinear periphery of the planar wall. Alternatively, the crush score line may take the form of a sinusoidal curve or saw tooth pattern extending along an axis spaced from and generally parallel to the curvilinear periphery of the planar wall.

Still another object of the invention is to provide a method for press forming a circular product such as a bowl, plate, tray, etc. from paperboard having a machine directionality wherein the tendency for non-symmetrical spring back due to the machine directionality of the paperboard is counteracted by a unique crush scoring of the blank prior to press forming.

Still other and more specific objects and features of this invention may be understood from an examination of the following description of the preferred embodiment.

DETAILED DESCRIPTION OF THE PREFERRED EMBODIMENT

Throughout this application, the words "downward", "downwardly", "downturned", "upward", "upwardly" and "upturned" will correspond, respectively, to the directions toward and away from the surface supporting the product (e.g., a table top). The words "inward", "inwardly", "outward" and "outwardly" will correspond, respectively, to the directions toward and away from the longitudinal axis passing through the center of the product.

Figure 1:
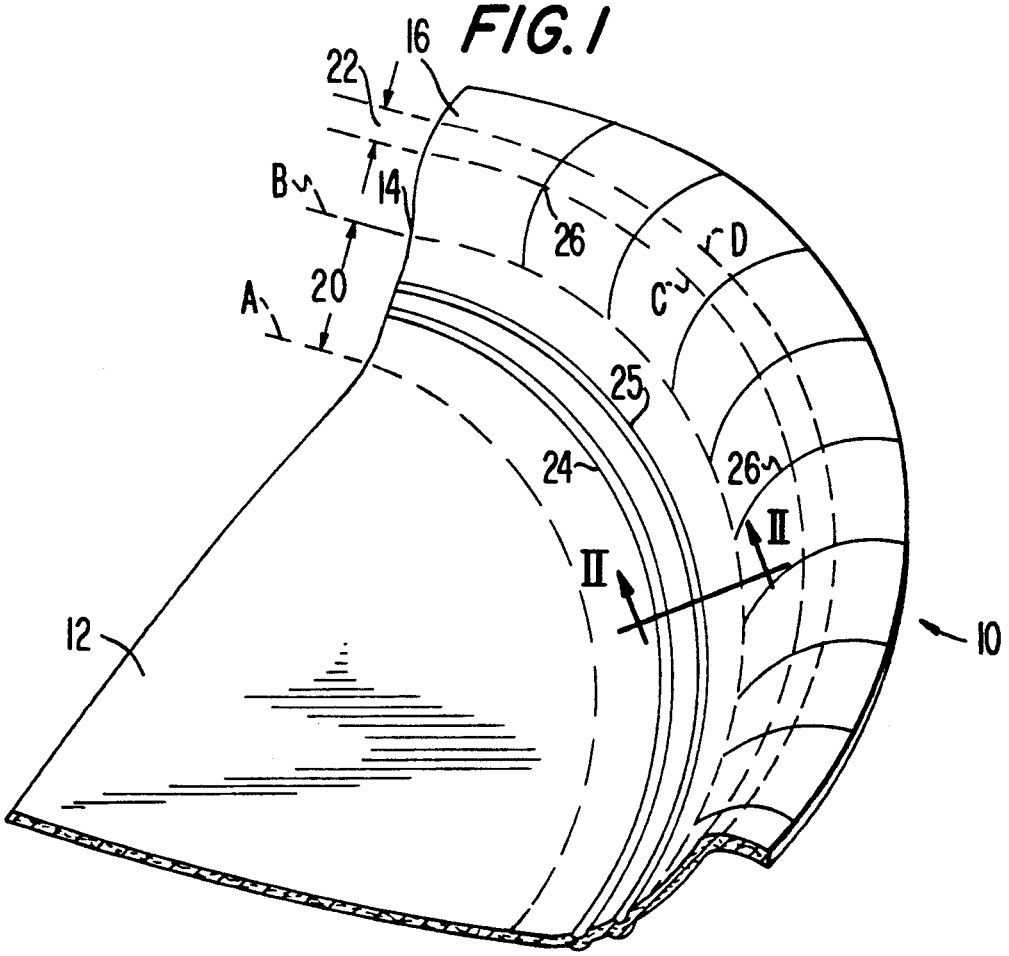
FIG. 1 is a perspective view of a broken away portion of a product formed in accordance with the present invention.

Referring to FIG. 1, a portion of a press-formed paperboard plate 10 is illustrated including a planar wall 12, a peripheral wall 14, and a press formed three-dimensional curvilinear region 20 between lines A and B. The plate 10 also includes a rim portion 16 and a second curvilinear region 22 between lines C and D. The phantom lines A–D in FIG. 1 have been provided to identify the various structural segments and to indicate the approximate location of the periphery of these segments. The phantom lines do not represent actual lines appearing on plate 10.

The planar wall 12 includes a circular periphery, represented generally by line A. A novel crush score line arrangement in accordance with the present invention is provided in the three dimensional curvilinear region 20. The crush score line arrangement facilitates the press forming of a paperboard product into the desired three-dimensional shape and the maintenance of the desired product shape in any press formed paperboard product or method of forming the same in which the periphery of the planar wall is at least partially three dimensionally curvilinear.

The three dimensional curvilinear region 20 and the peripheral wall 14 are angularly oriented with respect to the planar wall 12 and extend 360° around the circular periphery of the planar wall 12. In the preferred embodiment of the product of the present invention, as illustrated in FIG. 1, the three dimensional curvilinear region 20 and the peripheral wall 14 are angularly oriented upwardly (i.e. upturned) with the respect to the planar wall 12 and form a surface of revolution about the central axis of the plate 10. Further, the region 20 and peripheral wall 14 extend around the entire circular periphery of the planar wall 12.

Figure 2:
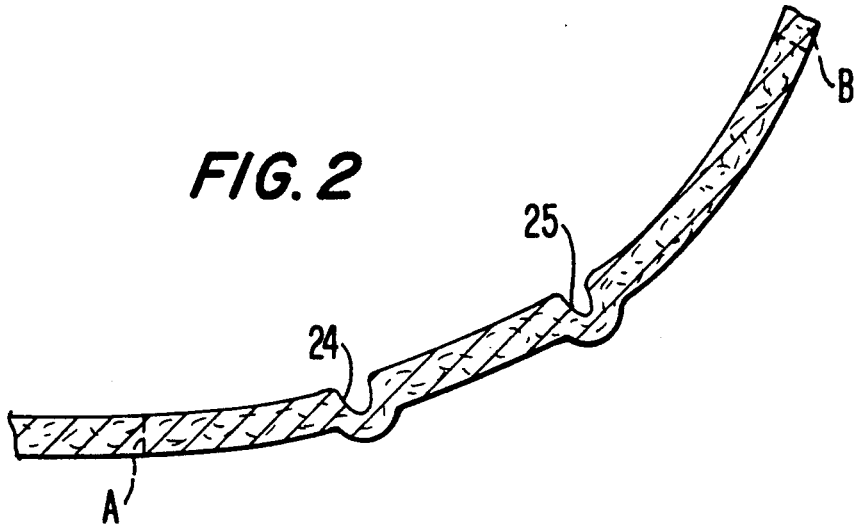
FIG. 2 is an enlarged, fragmentary cross-sectional view taken in a radial plane along section lines II—II of FIG. 1.

In radial cross-section the curvilinear three dimensional region 20 and peripheral wall 14 may have constant radii of curvature. A fragmentary portion of such a radial cross sectional view is shown in FIG. 2, taken along line II—II of FIG. 1. The term radial cross section refers to a cross section taken in a plane which includes the central axis of the plate 10 and extends radially therefrom. In FIG. 2, the region 20 is illustrated as having a substantially constant radius of curvature, but in many plate designs, the radius of curvature may vary in the radial direction.

As illustrated in both FIGS. 1 and 2, the three-dimensional curvilinear region 20 contains circular crush score lines 24 and 25 which facilitate press formation and maintenance of the desired product shape (e.g., circularly symmetrical about the products central longitudinal axis). The crush score lines 24 and 25 extend along the entire peripheral length of the curvilinear region 20 in a direction generally parallel to the periphery of the planar wall 12. Further, the crush score lines 24 and 25 are spaced at successively greater radial distances from the periphery of the planar wall 12, forming an arrangement of concentric rings.

As further illustrated in FIG. 1, plate 10 also includes a second curvilinear region 22 and a rim portion 16. The second curvilinear region 22 extends from the outer periphery of the peripheral wall 14, defined by line C, to the rim portion 16, defined by line D.

The peripheral wall 14, second curvilinear region 22 and rim portion 16 may include a plurality of radially extending score lines 26 circumferentially spaced about the curvilinear periphery of the planar wall 12. The radially extending score line arrangement provides for a paperboard product with uniformly created wrinkles or pleats to accommodate the necessary charge in area of the peripheral wall 14. It is not necessary that the radially extending score lines 26 extend perpendicular to the curvilinear portion of the periphery of the planar wall 12, as shown in FIG. 1. The radially extending score lines 26 require only a substantial directional component extending generally perpendicular to the curvilinear portion of the periphery of the planar wall 12.

Figure 3:
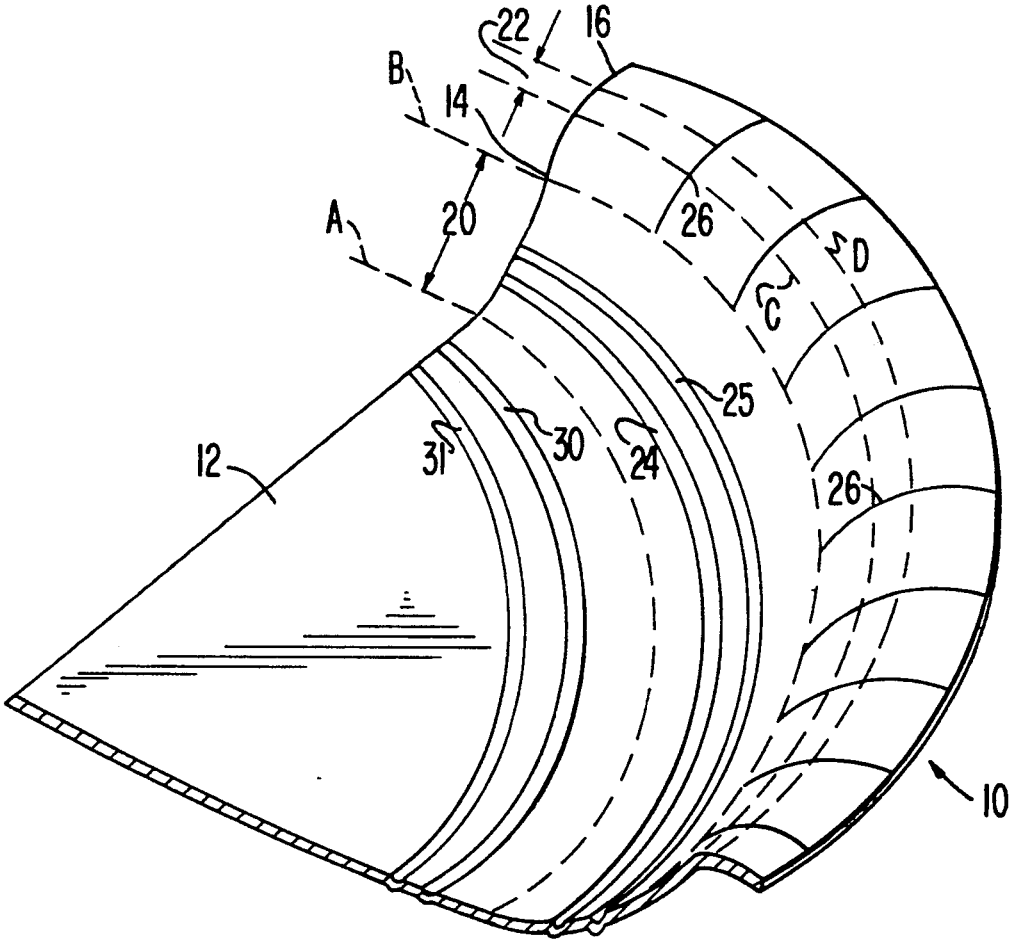
FIG. 3 is a perspective view of a broken away portion of a product formed in accordance with the present invention including an alternative crush score line configuration.

Referring to FIG. 3, a portion of a press-formed paperboard plate 10 formed in accordance with the present invention is illustrated including circular crush score lines 30 and 31 formed on the planar wall 12, which function to further facilitate press formation and maintenance of the desired product shape (e.g., circularly symmetrical about the products central longitudinal axis). The crush score lines 30 and 31 extend along the entire peripheral length of the planar wall 12 in a direction generally parallel to the periphery of the planar wall 12. Further, the crush score lines 30 and 31 are spaced at successively smaller radial distances from the periphery of the planar wall 12, forming an arrangement of concentric rings.

Figure 4:
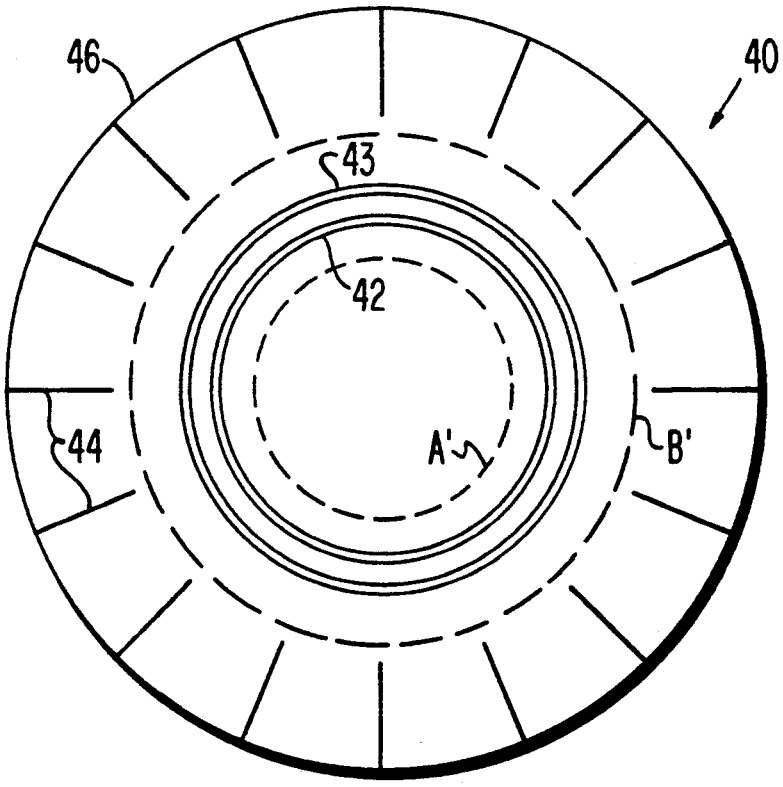
FIG. 4 is a top plan view of a paperboard blank from which a product of the present invention is formed.

The product of the preferred embodiment of the present invention is press-formed from a paperboard blank 40, as shown in FIG. 4. Preferably, the blank 40 is a unitary, flat piece of paperboard stock conventionally produced by a wet laid papermaking process and typically available in the form of a continuous web on a roll. The paperboard is typically bleached pulp furnish with double clay coating on one side. Preferably the paperboard stock has a moisture content varying from 2.0% to 12.0% by weight.

The paperboard stock used for the blank, will normally have a weight in the range of 100 pounds to 400 pounds per ream (3000 sq. ft.) and a thickness or caliper in the range of about 0.008 inch to 0.050 inch. Selecting a paperboard having a basis weight and caliper in the lower end of the range will reduce the blanks resistance to forming and may provide economic advantages, however, this must be balanced against the lower strength and rigidity obtained with the lighter paperboard. The invention of the present application can be applied to a paperboard having basis weight and caliper values throughout the entire rang specified above, to facilitate formation and maintenance of the desired product shape. The invention is particularly advantageous in that a paperboard having a basis weight and caliper in the higher end of the range can be utilized, resulting in a product having greater rigidity, while not presenting the formation problems normally experienced with heavier paperboard. The paperboard of the blank of the present invention has a density, in basis weight per 0.001 inch of caliper, preferably, in the range of 8 to 14 pounds per ream.

It is understood that the product of the present invention may be of varying types and sizes and used for numerous applications. Typically, the applications for which such products are utilized involve holding food or liquids. Accordingly, one side of the blank is preferably coated with one or more layers of a known liquid-proof coating material. In addition, for aesthetic purposes, one side of the blank may be printed with a design or other printing before application of the liquid-proof coatings. It is also preferred that the coatings selected be heat resistant.

In accordance with the invention, the paperboard blank 40 from which the paperboard product is press-formed includes a novel score line arrangement for controlling the effects of the machine directionality of the paperboard to ensure the formation of a product having the desired three dimensional product shape, for alleviating a significant measure of the resistance that occurs during the forming operation and for enhancing the products ability to maintain the desired shape (e.g., round). This unique score line arrangement, in accordance with the preferred embodiment of the present invention, includes crush score lines 42, 43 and 44.

The paperboard web (not shown) from which the press-formed paperboard product is formed has a machine directionality, which is determined by the direction in which the paper stock was laid to form the web. The paperboard's memory or tendency to spring back to its original shape (i.e., flat) is greatest in the machine direction and least in the cross-machine direction. These varying resistances to bending have a significant impact on the blanks ability to assume and maintain the desired product shape. The crush score lines 42 and 43 facilitate the bending of the blank in the portion extending between lines A' and B' by controlling the effects of the paperboard's differing memory caused by the machine directionality of the paperboard.

The crush score lines 42 and 43 of the present invention are particularly effective in facilitating the formation of a finished product for Which a round shape is desired. The machine directionality of the paperboard presents significant problems in the forming of a round-shaped product. As indicated above, the memory or tendency of the paperboard to return to its original shape (i.e., flat) is greatest in the machine direction and least in the cross machine direction. As a result, a product formed from a blank, not including the novel concentric-ring score line arrangement of the present invention, would be more nearly oval-shaped than the desired round shape. In contrast, a product formed from a blank including the score lines 42 and 43 to control the effects of the machine directionality of the paperboard, would be more nearly round-shaped than oval.

As illustrated in FIG. 4., the score line arrangement of the present invention may also include score lines 44, disposed in another portion of the blank 40 which will undergo substantial bending during formation, defined by the phantom line B' and the peripheral edge 46 of the blank 40. This portion is formed into the peripheral wall 14, second curvilinear region 22 and rim portion 16 of the plate 10 of FIG. 1. In order to reduce the resistance to bending and accommodate for the area change experienced during the forming operation in the portion of the blank 40 defined by the line B' and the peripheral edge 46, a plurality of radially extending score lines 44 are disposed in the portion on the blank 40.

The score lines 44, preferably in the range of 10 to 100 lines, are circumferentially spaced about phantom line B', which represents the curvilinear periphery of the planar wall 12 of the plate 10 of FIG. 1. During the forming operation, the score lines 44 facilitate the bending of the subject portion by accommodating for the change in area of the blank 40. The score lines 44 allow for the controlled formation of pleats, resulting in the formation of a uniform finished product having the desired shape. It is understood that while the preferred embodiment of the present invention includes radially extending score lines 44, numerous other embodiments are possible in accordance with the present invention wherein the score line arrangement includes only the score lines 42 and 43 discussed above.

While the product in accordance with the preferred embodiment of the present invention includes a concentric-ring crush score line arrangement, numerous alternative embodiments of products having different score line arrangements are possible. To enjoy the objects and advantages of the present invention, it is not necessary in every instance that the peripherally extending crush score lines 24 and 25, shown in FIG. 1, extend entirely parallel to the curvilinear portion of the periphery of the planar wall 12. The peripherally extending crush score lines 24 and 25, disposed in the three-dimensional curvilinear region 20, require only a substantial directional component extending generally parallel to the curvilinear portion of the periphery o the planar wall. In addition, it is understood that a product in accordance with the present invention need only include a single crush score line 24, or may include a plurality of crush score lines. Therefore, the peripherally extending score lines 24 and 25 may be formed in patterns differing from that shown in FIG. 1 and the patterns may include a single score line or a plurality of score lines, while still being formed in accordance with the present invention.

Figure 5:
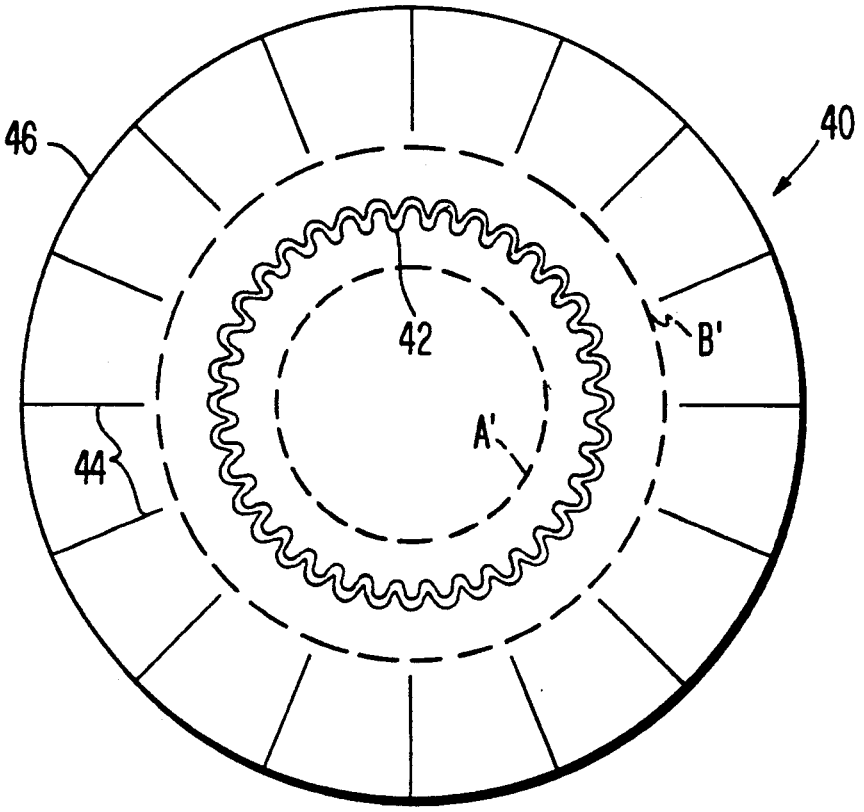
FIG. 5 is a top plan view of a first alternative embodiment of a paperboard blank from which a product of the present invention is formed.
Figure 6:
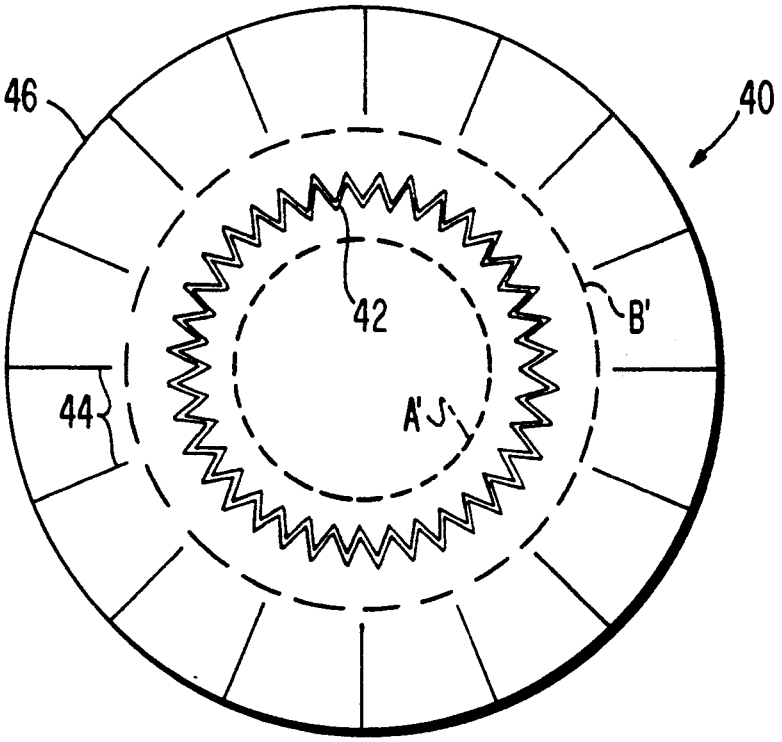
FIG. 6 is a top plan view of a second alternative embodiment of a paperboard blank from which a product of the present invention is formed.

For example, referring to FIGS. 5 and 6, alternative embodiments of the present invention are shown, wherein the score line arrangement includes a crush score line 42 forming a sinusoidal pattern, in FIG. 5, and a saw tooth pattern, in FIG. 6. These two alternative patterns, wherein the crush score line 42 has a substantial directional component extending generally parallel to the portion defined by lines A' and B', and the numerous other patterns possible in accordance with the present invention, result in a blank presenting reduced resistance during the forming operation and an improved capability to assume and maintain the desired product shape, just as in the preferred embodiment described above. For example, products in accordance with the present invention may be rectangular shaped, triangle shaped or trapezoid shaped including a planar wall having a periphery which is curvilinear only in the regions forming the corners of the various products. The invention described herein is not limited to the preferred embodiment shown in FIG. 1. The peripheral wall 14 may be angularly oriented upwardly (i.e., upturned) or downwardly (i.e., downturned) with respect to the planar wall 12 and may form an angle between the planer wall 12 and peripheral wall 14 in the range from 1 to 359 degrees. Also, the peripheral wall 14 need only extend along at least a portion of the curvilinear periphery of the planar wall 12. The objects and advantages of the present invention are still achieved by including the unique score line arrangement of the present invention in the numerous variations of press formed paperboard products which are possible in view of the foregoing.

The invention of the subject application should not be viewed as being limited to the embodiments shown. Numerous types and sizes of press-formed paperboard products having the score line arrangement of the present invention are possible. For example, the product may be a round-shaped plate, a round-shaped tray or platter, or a rectangular-shaped plate, tray or platter having curvilinear corner portions. Further, as noted above, the score line arrangement of the present invention may be utilized without the radially extending score lines disclosed in the preferred embodiment of the invention. These design changes may be made without departing from the spirit and scope of the invention as the same will now be understood by those skilled in the art as encompassing the full scope of the appended claims.

Industrial Applicability

This invention has particular utility in the formation of pressed-formed paperboard products, such as plates, bowls, platters and trays and especially in association with the formation of press-formed paperboard products for which a round-shape or partial round-shape is desired.

I claim:

1. A product press formed from paperboard having a machine direction comprising:

(a) a planar wall having a periphery which is at least partially curvilinear;

(b) a peripheral wall angularly oriented with respect to said planar wall and extending along at least a portion of the curvilinear periphery of said planar wall, the closest portion of said peripheral wall being spaced a substantial radial distance from the periphery of said planar wall; and (c) a press formed three-dimensional curvilinear region having a desired shape extending radially outwardly from said curvilinear periphery of said planar wall while simultaneously curving out of the plane defined by said planar wall, said press formed curvilinear region containing means for preventing the machine directionality of the paperboard from distorting the product from its desired shape, wherein said means for preventing paperboard from distorting is located between said planar wall and said peripheral wall within said three-dimensional curvilinear region.

2. A product as defined in claim 1, wherein said means for preventing the machine directionality of the paperboard from distorting the product from its desired shape includes a peripherally extending crush score line having a substantial directional component extending generally parallel to the curvilinear portion of the periphery of said planar wall.

3. A product as defined in claim 2, wherein said peripheral wall extends around substantially the entire periphery of said planar wall.

4. A product as defined in claim 3, wherein said planar wall is curvilinear around its entire periphery and wherein said press formed curvilinear region and said peripheral wall are co-extensive with the curvilinear portion of said planar wall.

5. A product as defined in claim 4, wherein said crush score line extends along the entire peripheral length of said curvilinear region in a direction generally parallel to the periphery of said planar wall.

6. A product as defined in claim 5, wherein said score line is formed by plural generally parallel score lines spaced at successively greater radial distances from the periphery of said planar wall.

7. A product as defined in claim 5, wherein said score line is formed in a generally sinusoidal pattern throughout said press formed curvilinear region.

8. A product as defined in claim 5, wherein said score line is formed of a plurality of score line segments formed in a generally saw tooth pattern.

9. A product as defined in claim 5, wherein said score line is formed of a plurality of score line segments formed on opposite sides of said curvilinear region.

10. A product as defined in claim 1, wherein said peripheral wall includes a plurality of radially extending score lines circumferentially spaced about the curvilinear periphery of said planar wall and having a substantial directional component extending generally perpendicular to the curvilinear portion of the periphery of said planar wall.

11. A product as defined in claim 10, wherein said peripheral wall includes 10 to 100 radially extending score lines equally spaced about the curvilinear periphery of said planar wall.

12. A product as defined in claim 1, wherein said planar wall contains means for preventing the machine directionality of the paperboard from distorting the product from its desired shape.

13. A product as defined in claim 12, wherein said means for preventing the machine directionality of the paperboard from distorting the product from its desired shape includes a peripherally extending crush score line having a substantial directional component extending generally parallel to the curvilinear portion of the periphery of said planar wall.

14. A product press formed from paperboard comprising:

(a) a planar wall having a periphery which is at least partially curvilinear;

(b) a peripheral wall angularly oriented with respect to said planar wall and extending along at least a portion of the curvilinear periphery of said planar wall, the closest portion of said peripheral wall being spaced a substantial radial distance from the periphery of said planar wall; and (c) a press formed three-dimensional curvilinear region having a desired shape extending radially outwardly from said curvilinear periphery of said planar wall while simultaneously curving out of the plane defined by said planar wall, said press formed curvilinear region containing formation improvement means for facilitating press formation and maintenance of said desired shape, said means including a peripherally extending crush score line having a substantial directional component extending generally parallel to the curvilinear portion of the periphery of said planar wall, wherein said formation improvement means is located between said planar wall and said peripheral wall within said three-dimensional curvilinear region.

15. A product as defined in claim 14, wherein said peripheral wall extends around substantially the entire periphery of said planar wall.

16. A product as defined in claim 15, wherein said planar wall is curvilinear around its entire periphery and wherein said press formed curvilinear region and said peripheral wall are co-extensive with the curvilinear portion of said planar wall.

17. A product as defined in claim 16, wherein said crush score line extends along the entire peripheral length of said curvilinear region in a direction generally parallel to the periphery of said planar wall.

18. A product as defined in claim 17, wherein said score line is formed by plural generally parallel score lines spaced at successively greater radial distances from the periphery of said planar wall.

19. A product as defined in claim 17, wherein said score line is formed in a generally sinusoidal pattern throughout said press formed curvilinear region.

20. A product as defined in claim 17, wherein said score line is formed of a plurality of score line segments formed in a generally saw tooth pattern.

21. A product as defined in claim 17, wherein said score line is formed of a plurality of score line segments formed on opposite sides of said curvilinear region.

22. A product as defined in claim 14, wherein said peripheral wall includes a plurality of radially extending score lines circumferentially spaced about the curvilinear periphery of said planar wall and having a substantial directional component extending generally perpendicular to the curvilinear portion of the periphery of said planar wall.

23. A product as defined in claim 22, wherein said peripheral wall includes 10 to 100 radially extending score lines equally spaced about the curvilinear periphery of said planar wall.

24. A product as defined in claim 14, wherein said planar wall contains means for preventing the machine directionality of the paperboard from distorting the product from its desired shape.

25. A product as defined in claim 24, wherein said means for preventing the machine directionality of the paperboard from distorting the product from its desired shape includes a peripherally extending crush score line having a substantial directional component extending generally parallel to the curvilinear portion of the periphery of said planar wall.

* * * * *